United States Patent [19]

Griffis

[11] Patent Number: 5,038,407

[45] Date of Patent: Aug. 13, 1991

[54] DEVICE FOR STOPPING A FALLING SNOW SKIER

[76] Inventor: Jimmy M. Griffis, 2838 Camphor St., La Verne, Calif. 91750

[21] Appl. No.: 418,099

[22] Filed: Oct. 6, 1989

[51] Int. Cl.[5] ..... A41D 13/00

[52] U.S. Cl. ..... 2/2; 280/809; 280/28.11; 188/5

[58] Field of Search ..... 280/809, 810, 18, 28.11; 224/153; 188/5, 6, 7, 8; 114/311; 441/114, 115, 116; 2/2.5, 46, 44, 2, 1

[56] References Cited

U.S. PATENT DOCUMENTS 3,179,963 4/1965 Peterson ..... 441/115

*Primary Examiner*—Andres Kashnikow
*Assistant Examiner*—Richard Camby
*Attorney, Agent, or Firm*—Lyon & Lyon

[57] ABSTRACT

A device for stopping a fallen skier. The device may be worn by a snow skier, the device having a surface which will provide a braking action against the snow if the skier falls. In a preferred embodiment, the device includes a plurality of foam blocks arranged on a rectangular piece of fabric which may be strapped onto the skier's back. The blocks have an outwardly pointing wedge shape which provides an outward edge which can produce a braking force when in contact with the snow surface.

14 Claims, 1 Drawing Sheet

DEVICE FOR STOPPING A FALLING SNOW SKIER

BACKGROUND OF THE INVENTION

The field of the present invention relates to accessories for snow skiing.

Snow skiing is a popular but somewhat hazardous recreational sport. A majority of ski injuries occurs when the skier falls. Some injuries occur after the skier falls and the skier, being unable to stop, continues to slide down the hill into a solid object or over a drop off. Once in motion, it is often difficult for the fallen skier to obtain a grip on the snow surface, particularly where the snow surface is hard or the slope is very steep.

When a skier falls on a steep grade, he will attempt to stop himself by positioning himself with his feet downward and the skis perpendicular to the downward slope in order to get a ski edge into the snow surface to provide a braking force. This stopping technique is often difficult and in circumstances where the skis have been released, the skier has virtually no means with which to brake himself.

SUMMARY OF THE INVENTION

The present invention is directed to a device which may be worn by a snow skier, the device having a surface which will provide a braking action against the snow if the skier falls. In a preferred embodiment, the device includes a plurality of foam blocks arranged on a rectangular piece of fabric which may be strapped onto the skier's back. The blocks have an outwardly pointing wedge shape which provides an outward edge which can produce a braking force when in contact with the snow surface.

DETAILED DESCRIPTION OF THE PREFERRED EMBODIMENT

The preferred embodiment for the present invention will now be described with reference to the drawings. A particular element is represented by the same numeral in any figure.

Figure 1:
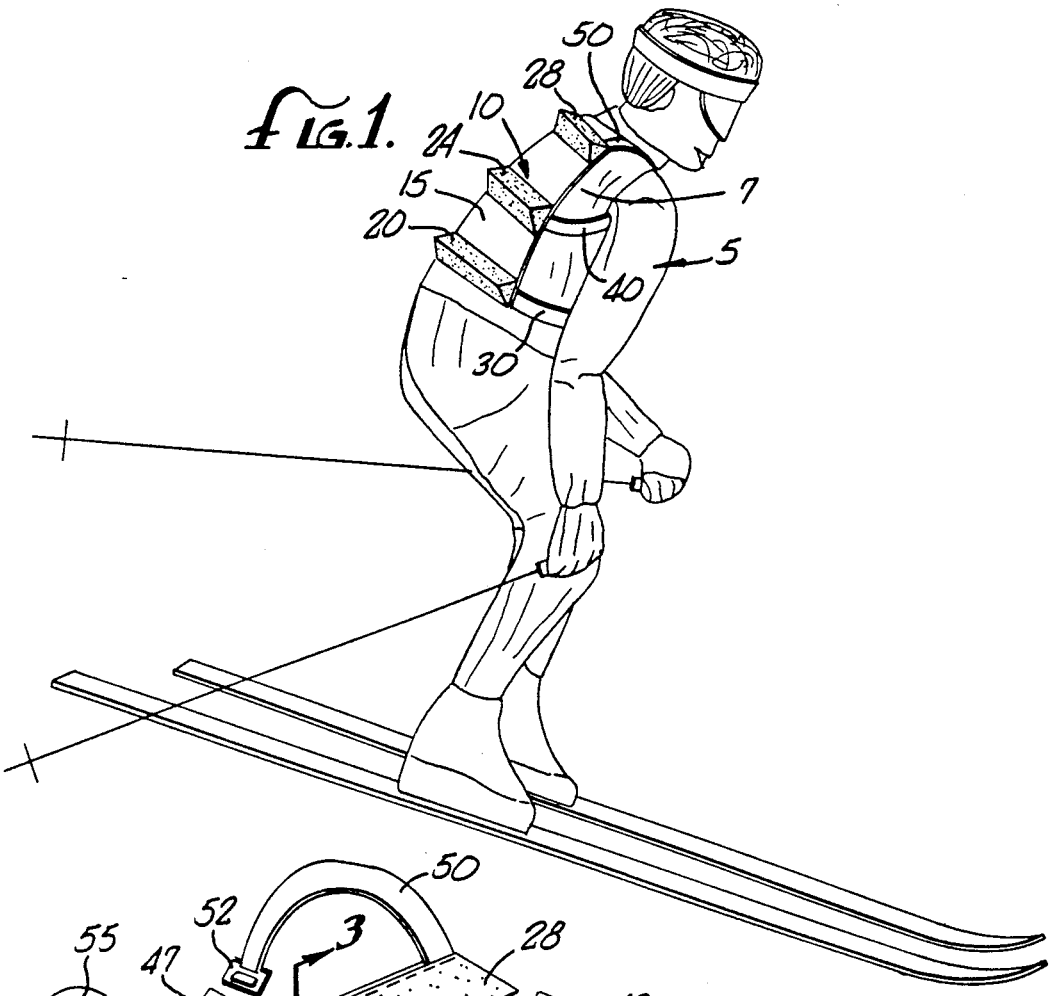
FIG. 1 is a perspective view of a skier wearing a preferred embodiment of the present invention.

FIG. 1 illustrates a skier 5 wearing a brake device 10. The brake device 10 includes three wedge shaped blocks 20, 24 and 28 mounted on a rectangular mounting piece 15 secured by straps 30, 40 and 50 to the skier 5.

To facilitate description, directions are arbitrarily defined relative to an upright skier, standing vertically. The skier's skis and the wedge shaped blocks 20, 24, 28 are arranged generally horizontally and the rectangular support piece 15 is positioned in a vertical plane.

Figure 2:
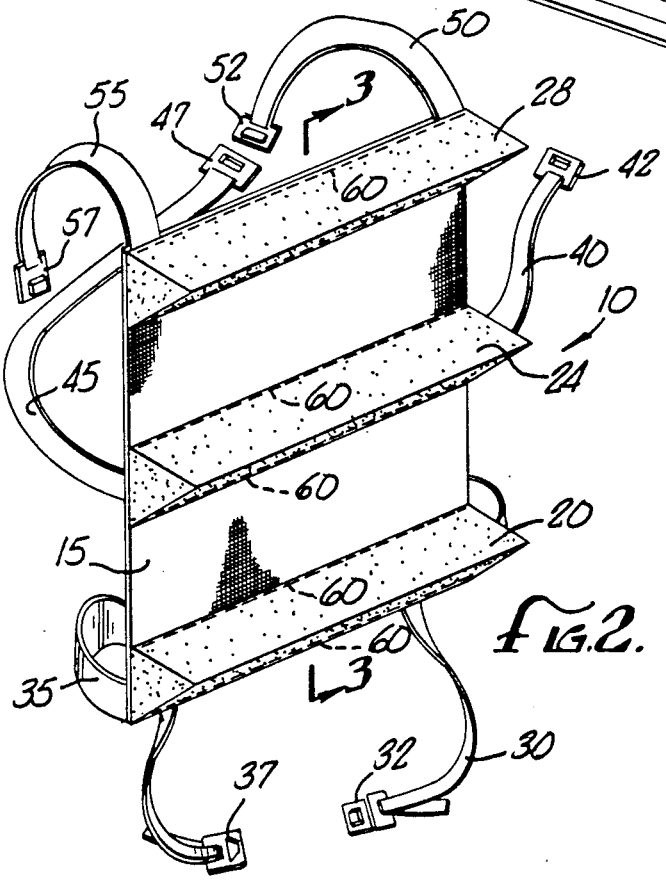
FIG. 2 is a perspective view of the preferred embodiment according to the present invention.
Figure 3:
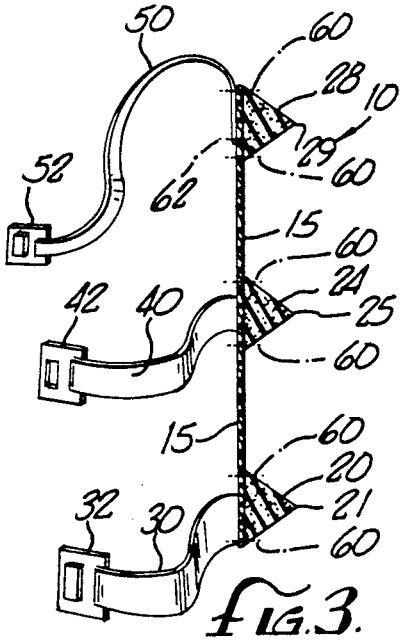
FIG. 3 is a cross-sectional view of the device of FIG. 2 taken along the line 3—3.

Details of the brake device 10 are illustrated in FIGS. 2 and 3. Brake device 10 includes a rectangular support piece 15 which may be constructed from a flexible fabric such as nylon. The material preferably has a thickness of about ⅛" to provide a sturdy support structure, the material chosen to handle moisture, cold and physical abuse without tearing as will be encountered in use.

The brake device 10 is illustrated with three wedge shaped blocks 20, 24, 28 positioned parallel to one another and spaced about the support surface 15. Each wedge shaped block is securely fastened to the support piece 15 such as by a suitable adhesive or by rows of stitching 60 attaching the outer edges of each block 20, 24, 28 to the support surface 15.

A block such as 24 is preferably constructed in one piece from a stiff, relatively hard foam material such as polyethylene. The material needs to be hard and stiff enough to maintain its shape, particularly its outward edge which needs to support a braking edge to stop a fallen skier. It is desirable that the material have some compressive properties which would support a cushioning effect for the skier against hard packed snow.

Many shapes and materials may be used to provide a braking surface for the device. What is most needed, however, is an outwardly (relative to the skier) facing edge which contacts the snow to provide a scraping effect similar to the edge of a ski or ice skate. Of course, to be effective, an edge must be oriented perpendicular to the direction of motion. The blocks 20, 24 and 28 are arranged parallel to one another so that they all provide braking effect in the same direction. Blocks could be added in other orientations so that braking effect could be applied for other orientations of the skier.

Alternately, a block may be comprised of a long angle piece (having an "∠" shaped cross section) made of stiff material such as a hard plastic. One leg of the angle piece is attached to the fabric piece 15 with the other extending outward at a slight angle. The angle shape allows for some flexibility, for cushioning effect, as well as providing the desired outer edge to supply the braking effect.

When the skier falls, the block edges grip the snow applying a braking force at the skier's back. The momentum of the remainder of the skier's body, such as the feet, remains greater so the skier's body will orient itself with the feet pointing down the hill and the head pointing upward. It is in this position that the skier has the most control over his fall as well as having his feet encounter solid objects rather than his head or arms. On his back, the skier can also see where he is going. Therefore when the skier falls, he only need position himself on his back in order for the braking device to take effect.

The device 10 may be strapped on to the skier's back or incorporated into a piece of clothing such as a vest or jacket. FIGS. 1–3 illustrate a strap version which attaches to a skier's back in a fashion similar to a backpack. A top portion of the device 10 has top straps 50 and 55 secured to a top edge which pass over the skier's shoulders in a crossing fashion across the skier's chest. Center straps 40 and 45 are attached to a side edge of the support piece 15 wrapping around the chest of the skier under his arm with the clip 42 on the end of strap 40 being secured into the clip 57 on the edge of the strap 55. Similarly, the clip 47 on the end of strap 45 snaps into the mating clip 52 on the end of strap 50. This crossing pattern ensures a secure fit for the device 10 on the back 7 of the skier 5. The bottom portion of the device 10 has straps 30, 35 attached along the bottom edge, the straps 30, 35 being drawn around the waist of the skier 5. Clip 37 on the end of strap 35 is then engaged into clip 32 on the end of strap 30. The clips provide for adjustment along a respective strap to provide a desired fit.

Thus a braking device worn by a snow skier has been shown and described. Though specific embodiments have been illustrated and described, many modifications will become obvious to one skilled in the art from the descriptions herein. Therefore the scope of the invention is not to be limited except in the spirit of the following claims.

I claim:

1. A device for stopping a fallen snow skier comprising a rectangular piece of fabric having a plurality of straps attached thereto for strapping the fabric in place onto the skier's back, when in place, the rectangular piece is positioned in a plane generally parallel to the skier's back with one side against the skier's back;

a plurality of elongated solid foam blocks attached to the other side of the rectangular piece and arranged with their axes generally parallel to one another, wherein each of the blocks include a stiff outwardly facing edge for contacting the snow to stop the skier during a fall.

2. The device of claim 1 wherein each of the blocks has a triangle shaped cross section with one side of the triangle positioned against the support surface.

3. The device of claim 2 wherein the blocks are arranged generally horizontally when the devices is in place on the skier's back.

4. The device of claim 1 wherein each of the blocks has a wedge shape.

5. A device for stopping a fallen snow skier comprising a flexible support surface and a plurality of elongated blocks being attached to and arranged generally horizontally on the flexible support surface, the flexible support surface being constructed and arranged to be worn on the back of the snow skier, wherein each of the blocks has a triangular cross section with one side of the triangle positioned against the support surface and with the a corner of the triangle extending out from the flexible support surface forming an outwardly facing edge.

6. The device of claim 5 further comprising a plurality of straps attached to the support surface for strapping the device onto the back of the skier.

7. The device of claim 5 wherein each of the blocks is formed out of a relatively hard foam material which permits some compression but maintains a stiff outer edge to provide a braking edge to stop a fallen skier.

8. The device of claim 5 wherein the device is incorporated into a piece of clothing.

9. The device of claim 5 wherein the support surface is comprised of a strong fabric material.

10. A device worn by a snow skier on his back comprising a support surface and a plurality of wedge shaped blocks attached to the support surface, each block being constructed and arranged with a stiff outwardly facing edge for contacting the snow to stop the skier during a fall.

11. The device of claim 10 wherein the device is incorporated into a piece of clothing.

12. The device of claim 10 wherein each wedge shaped block is comprised of an elongated angle piece having an "∠" shaped cross section with one ledge of the angle piece attached to the support surface and the outer leg extending outward to form the outwardly facing edge.

13. The device of claim 10 wherein each wedge shaped block is formed out of a relatively hard foam material which permits some compression but maintains a stiff outer edge to provide a braking edge to stop a fallen skier.

14. The device of claim 5 wherein each elongated block is formed out of a relatively hard form material which permits some compression but maintains a stiff outer edge to provide a braking edge to stop a fallen skier.

* * * * *

UNITED STATES PATENT AND TRADEMARK OFFICE

CERTIFICATE OF CORRECTION

PATENT NO. : 5,038,407

DATED : August 13, 1991

INVENTOR(S) : Jimmy M. Griffis

It is certified that error appears in the above-identified patent and that said Letters Patent is hereby corrected as shown below:

In claim 3 line 2 thereof (col. 3 line 27), change "devices" to --device--.

In claim 12 line 3 thereof (col. 4 line 24), change "ledge" to --leg--.

In claim 12 line 4 thereof (col. 4 line 25), before "attached" insert --being--.

In claim 12 line 5 thereof (col. 4 line 26), change "outer" to --other--.

In claim 14 line 2 thereof (col. 4 line 34), change "form" to --foam--.

Signed and Sealed this

Twenty-second Day of June, 1993

*Attest:*

Michael K. Kirk

MICHAEL K. KIRK

*Attesting Officer*

*Acting Commissioner of Patents and Trademarks*